US005113770A

United States Patent [19]

Godbe et al.

[11] Patent Number: 5,113,770

[45] Date of Patent: May 19, 1992

[54] APPARATUS FOR INCINERATING WASTE MATERIALS

[76] Inventors: Murray C. Godbe, 807 5th Ave., Salt Lake City, Utah 84103; Howard H. Nichols, 40 Churchill Rd., Pittsburgh, Pa. 15235

[21] Appl. No.: 712,578

[22] Filed: Jun. 10, 1991

[51] Int. Cl.[5] ..... F23N 5/00

[52] U.S. Cl. ..... 110/187; 110/190; 110/235

[58] Field of Search ..... 110/185, 186, 190, 235, 110/187

[56] References Cited

U.S. PATENT DOCUMENTS 4,424,754 1/1984 Coleman et al. ..... 110/190
4,700,637 10/1987 McCartney ..... 110/190 X
4,724,775 2/1988 May ..... 110/186
5,020,451 6/1991 Maebo et al. ..... 110/190 X

*Primary Examiner*—Edward G. Favors
*Attorney, Agent, or Firm*—Mallinckrodt & Mallinckrodt

[57] ABSTRACT

The waste incinerating system of Nichols U.S. Pat. No. 3,905,312 issued Sep. 16, 1975 is improved to prevent decreases in combustion temperature to an extent such that there is a danger of flame-out and consequent choking of the furnace chamber with wastes fed into such furnace chamber for incineration. A substantially immediately responsive, radiation sensing control, normally in the form of a standard radiation pyrometer focused on a radiation-responsive target in the furnace chamber, is incorporated in the system to augment fuel supply substantially immediately when required.

4 Claims, 4 Drawing Sheets

APPARATUS FOR INCINERATING WASTE MATERIALS

BACKGROUND OF THE INVENTION

1. Field

The invention is concerned with improving both the burning of waste materials and incinerator apparatus in which the burning is carried out.

2. State of the Art

Incineration of waste materials to the maximum extent possible from a practical standpoint has long been the aim of those concerned with waste disposal. Limits of practicality have been imposed by economic and atmospheric pollution considerations. Much development has taken place, but, as with technology in general, room for improvement remains.

A potentially significant waste incineration system was developed a number of years ago by one of the joint applicants herein, Howard H. Nichols, as disclosed in U.S. Pat. No. 3,905,312 issued Sep. 16, 1975. However, a drawback to effective commercialization was found to be a problem in the control of the burning, despite elaborate provisions made for control.

We have now realized that a fundamental difficulty existing in the burning of a continuous supply of highly diverse waste materials, which includes wet materials such as household and commercial garbage as well as liquid wastes, is that the moisture content of such wastes varies unpredictably over a wide range from time to time tending to unpredictably dampen the burning temperature to such an extent that there is a constant danger of extinguishing the fire.

SUMMARY OF THE INVENTION

In the making of the present invention, it was a principal object to overcome the afore-explained problem in the patented system and in other prior art systems.

This objective has been accomplished by supplying such a system with a moisture-reactive control governing the rate of feed of fuel to the incinerating apparatus, such as to the preheater chamber of the patented apparatus and, coincidentally, to the furnace chamber thereof, considerably more quickly than does the thermocouple and associated controls of the patented system, in accordance with changes in moisture content of the feed as determined by varying radiation changes in the combustion flames within the furnace chamber, thereby insuring steady burning conditions in such furnace chamber despite changes from time to time in moisture content of the feed materials to be incinerated.

Instrumentation is available for this purpose. Thus, a standard radiation pyrometer, appropriately placed in the furnace chamber of the patented apparatus, will sense moisture changes in terms of combustion radiation within such furnace chamber and will immediately react to such changes in radiation and will likewise almost immediately increase or decrease the supply of additional fuel to such preheater chamber through a by-pass arrangement in the system.

In applying the invention to incinerators other than that of the aforesaid Nichols patent, the important consideration is to immediately increase or decrease the supply of fuel to the furnace chamber in accordance with changes in moisture content of the atmosphere in the furnace chamber as represented by the intensity of radiation within such furnace chamber.

THE DRAWINGS

The best mode presently contemplated for carrying out the invention in actual practice is shown in the accompanying drawings, in which:

FIGS. 1, 2, and 3 are the same views as in the corresponding Figs. of the aforesaid Nichols U.S. Pat. No. 3,905,312, but modified to show the improvements of the invention; and FIG. 4, a block diagram indicating the control system of that prior Nichols patent, with the additional moisture-reaction control of the invention.

DETAILED DESCRIPTION OF THE ILLUSTRATED EMBODIMENT

In its illustrated form, the invention is shown incorporated in and as a modification of the previously patented Nichols' process and apparatus for incinerating waste materials, the aforesaid Nichols U.S. Pat. No. 3,905,312 being wholly incorporated herein by reference so as to form a part hereof.

Figure 1:
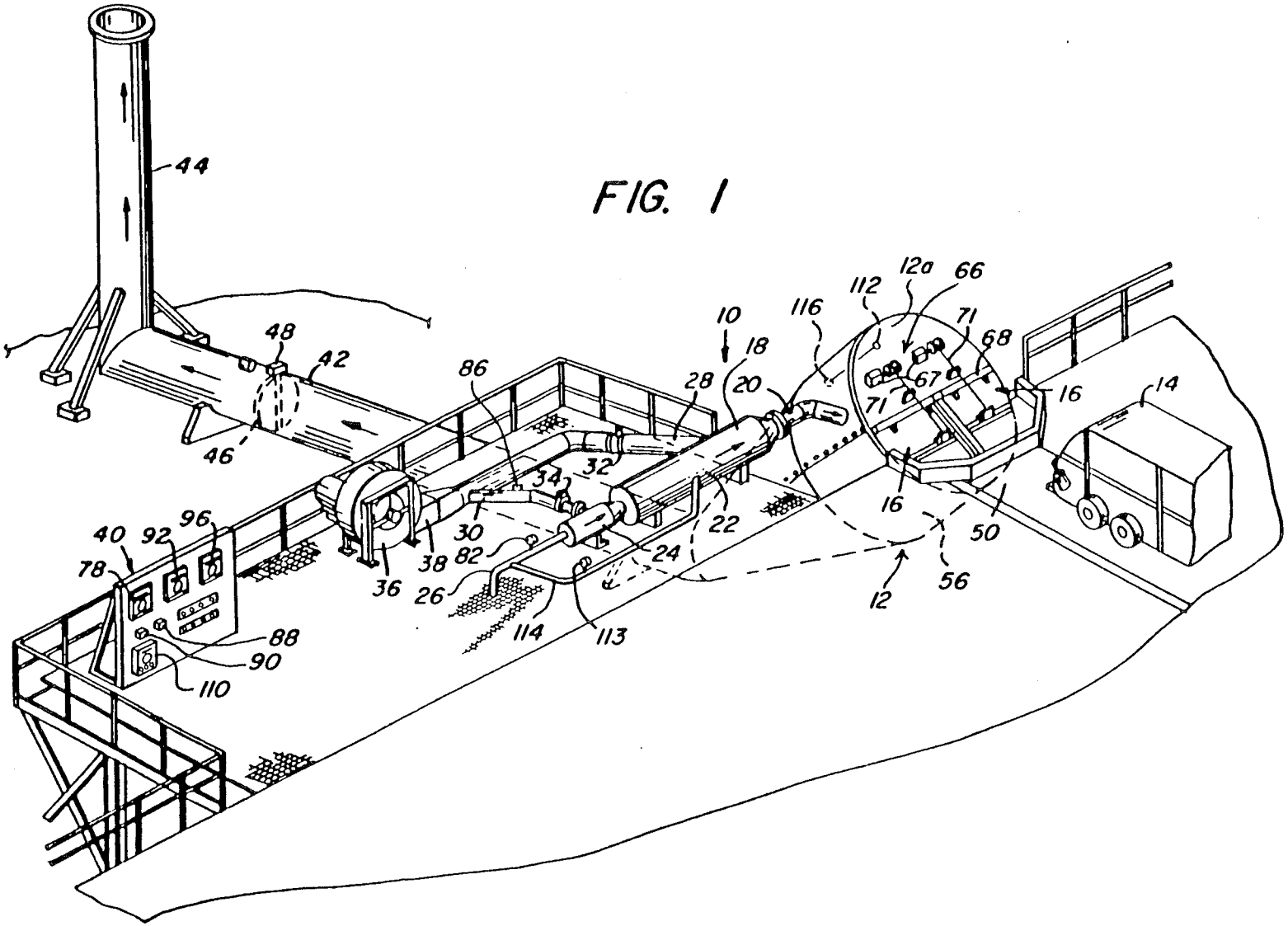
Figure 2:
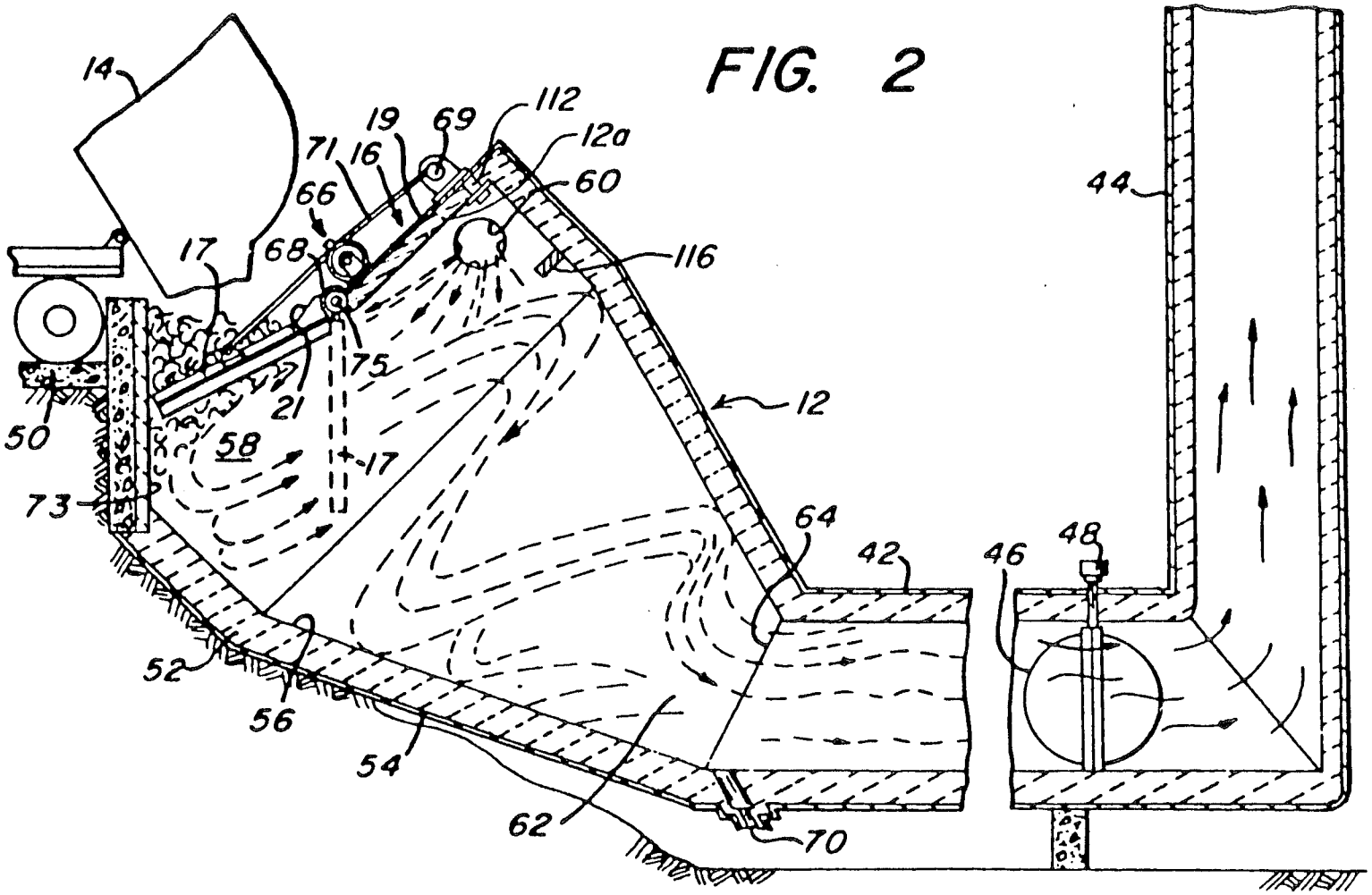
Figure 3:
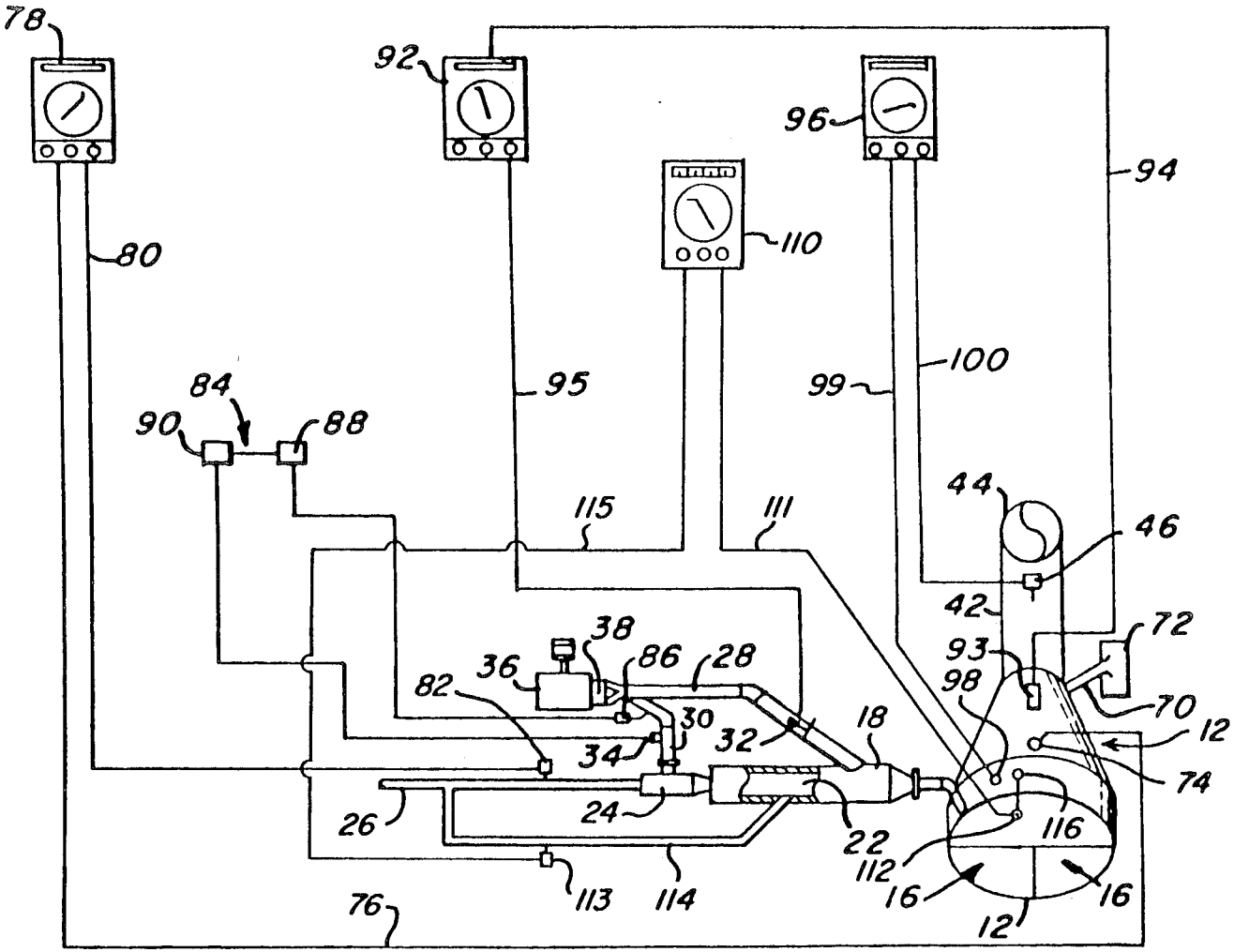

Thus, as shown in FIGS. 1–3 and incorporating the same reference numbers as in the Nichols patent, the Nichols incinerating system comprises an incinerating furnace 12 having a furnace chamber 56 within which is burned garbage and other waste materials dumped from a waste collecting truck 14 onto furnace doors 16 at an unloading dock 50. It is designed to operate at from 2,800 to 2,900 degrees F.

Furnace 12 is fired through an inlet 60, FIG. 2, by a mixture of burning fuel and hot air passed to inlet 60 by a conduit 20 from the combustion chamber 22, FIG. 3, of a preheater 18. A burner 24, having a fuel feed line 26, fires chamber 22. Air is fed to burner 24 through duct 30 and into combustion chamber 22 through duct 28 under the control of valves 34 and 32, respectively. A control panel 40, FIG. 1, monitors temperature and oxygen in furnace 12 and air-fuel rates in burner 24. Furnace chamber 56 leads into an outlet duct 42 and a stack 44 for carrying away the gases of combustion, while molten slag from non-combustibles that are melted in furnace chamber 56 flows through outlet 70 into a standard slag-granulating drum 72, FIG. 3.

The furnace operator can regulate the charge rate of waste materials into furnace chamber 56 by moving the lower end portion of the lower section 17, FIG. 2, of a door 16 a preselected distance away from the vertical wall 73 of furnace 12 by means of a hydraulic actuating device 66, FIG. 1, that includes hydraulic motors 67 regulated by the operator.

A platinum-rhodium thermocouple 74, FIG. 3, located in the upper end portion 58, FIG. 2, of furnace chamber 56 senses temperatures in such chamber and is connected by an electrical conduit 76 to a pre-programmed, standard, temperature recorder-controller 78 on control panel 40, which functions to control feed of fuel to the furnace. If furnace temperature should vary from the programmed temperature, valve 82 will regulate supply of fuel to burner 24. Supply of air to burner 24 is controlled by a fuel-air controller 84 which includes a measuring device 86 for monitoring the flow rate of air delivered from a blower 36 to duct 30. Device 86 is connected to a flow rate meter 88, which provides a continuous reading of the flow rate of air from blower 36. Such flow rate is automatically controlled by the position of valve 34 in duct 30, which is controlled by a regulator 90.

Heat produced by furnace 12 is also controlled by the amount of preheated air fed to furnace 12 from combustion chamber 22. The amount of air for complete combustion of a furnace charge of waste is dependent upon the rate of feed of waste into the furnace.

A conventional oxygen analyzer recorder-controller 92 on control panel 40 is connected by an electrical conduit 94 to a sensor 93 located in furnace chamber 56. Since oxygen requirements increase with increase in the feed of waste, the position of control valve 32 in air duct 28 is controlled by analyzer 92 transmitting electrical impulses through electrical conduit 95.

A conventional furnace pressure control device 96 on control panel 40 provides the furnace operator with a continuous reading of the air pressure in furnace chamber 56 by receiving electrical impulses from a pressure sensor 98, FIG. 3, in furnace chamber 56 through electrical conductor 99. It is programmed for a predetermined pressure to be maintained. Should the actual pressure vary, control device 96 will transmit electrical impulses through electrical conduit !00 to actuate a motor 48, FIG. 2, of damper 46, which will move such damper to a position that will restore furnace pressure to the predetermined level.

Figure 4:
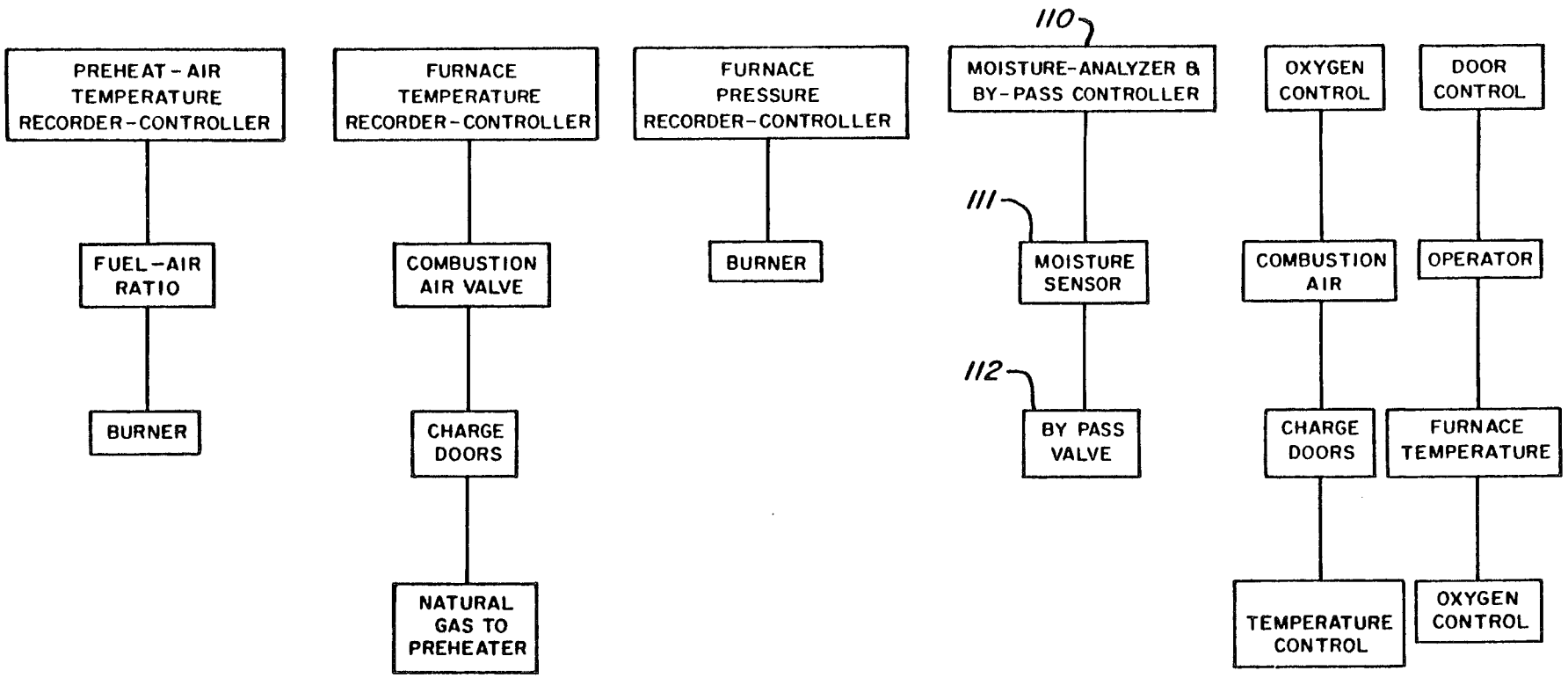

Despite all of these controls as summarized in the flow sheet of FIG. 4, it has been found that moisture in the feed waste materials can so depress furnace temperature that there is a constant danger of loss of flame and of eventual cooling and choking of the furnace with unburned waste which must be laboriously removed. Lowering of burn temperature in the furnace also results in the increase of gas emissions into the atmosphere.

In accordance with the present invention, this situation is avoided by installation of an additional control for furnace chamber 56, namely a moisture analyzer and by-pass controller 110, FIGS. 3 and 4, similar in construction to control devices 78, 92, and 96, and connected by an electrical conduit 111, FIG. 3, to a radiation pyrometer 112, see particularly FIG. 2, which may be of standard make commercially obtainable on the open market, for example as produced by Leeds & Northrup, Honeywell, and various other manufacturers. Such a radiation pyrometer functions in effect as a moisture sensor. A valve 1!3, FIG. 3, in a fuel bypass line 114 that leads from the fuel line 26 to the chamber 22 of air preheater unit 18 ahead of the combustion air, is controlled by moisture analyzer controller 110 by reason of its connection therewith by electrical conductor 115. Thus, when valve 113 is opened by controller 110, some fuel by-passes burner 24 and is fed directly into the chamber 22 of air preheater unit 18 for mixing with the combustion air passing into furnace 12. This immediately increases the flame in the furnace.

Radiation pyrometer 112 is preferably placed at the inside surface of the forward wall **12*a* of furnace 12 so as to be visually focused, as is usual with conventional use of such radiation pyrometers, on a standard target 116, FIG. 2, radiating heat energy in accordance with temperature, i.e. flame, conditions within furnace chamber 56. Such conditions are directly affected by the moisture content of the atmosphere within furnace chamber 56, and the response time is approximately 0.015 seconds as compared with approximately sixty seconds for a usual thermocouple such as the thermocouple 74** of the patented system.

It should be noted that, in this way, air preheat and flame temperature in the furnace are kept substantially constant despite changes in moisture content of the feed materials to be burned. Thus, without the invention, if moisture control of the feed is for example 20% with radiated flame temperature 3,640 degrees F. (operating burn temperature 2,900° F.), rise in moisture content of the feed to 40% would lower the radiated flame temperature to 3,100 degrees F. with proportional drop in the operating burn temperature of the furnace. With the invention, such lowering of radiated flame temperature would be sensed by the radiation pyrometer 112 to cause immediate increase in the fuel being fed to the furnace and immediate compensating increase in the operating burn temperature in the furnace.

The block diagram of FIG. 4 shows how the controls of the incineration system of the aforementioned Nichols U.S. Pat. No. 3,905,312 are interrelated and how they are interrelated with the added moisture analyze and its related controls.

Whereas, this invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

We claim:

1. In apparatus for incinerating wastes that include moisture-carrying materials, such as garbage and liquid waste, said apparatus comprising a furnace having an internal incinerating chamber, means for introducing said wastes into said incinerating chamber, means for introducing heat into said incinerating chamber, means for conducting combustion gases from said incinerating chamber, means for discharging non-combustible residual matter from said incinerating chamber, means for controlling rate of feed of said wastes to said incinerating chamber, means for supplying fuel to said means for introducing heat into said incinerating chamber, and means for controlling the rate of feed of fuel to said means for introducing heat into said incinerating chamber, the improvement comprising the provision of radiation sensing means for said incinerating chamber and connected to said means for controlling the rate of feed of fuel, so as to substantially immediately adjust combustion heat in said incinerating chamber in accordance with the intensity of heat radiated by flames within said incinerating chamber, said intensity of heat being affected by variations in the quantity of moisture in wastes being fed to said incinerating chamber from time to time; said means for introducing heat into the incinerating chamber comprising an auxiliary combustion chamber fueled by a burner into which the means for supplying fuel discharges, and further comprising a by-pass line leading directly into said auxiliary combustion chamber from said means for supplying fuel; valve means in said by-pass line; and control means connected with the radiation sensing means for controlling said valve means.

2. The improvement according to claim 1, wherein the radiation sensing means is a radiation pyrometer focused on a radiation-responsive target within the incinerating chamber.

3. Apparatus for incinerating wastes that include moisture-carrying materials, such as garbage and liquid waste, said apparatus comprising a furnace having an internal incinerating chamber; means for introducing said wastes into said incinerating chamber; means for introducing heat into said incinerating chamber; means for conducting combustion gases from said incinerating chamber; means for discharging non-combustible residual matter from said incinerating chamber; means for controlling rate of feed of said wastes to said incinerating chamber; means for supplying fuel to said means for introducing heat into said incinerating chamber; means for controlling the rate of feed of fuel to said means for introducing heat into said incinerating chamber; radiation sensing means for said incinerating chamber and connected to said means for controlling the rate of feed of fuel, so as to substantially immediately adjust combustion heat in said incinerating chamber in accordance with the intensity of heat radiated by flames within said incinerating chamber, said intensity of heat being affected by variations in the quantity of moisture in wastes being fed to said incinerating chamber from time to time; and said means for introducing heat into the incinerating chamber comprising a preheater for air to be introduced into said incinerating chamber, said preheater having an air-heating chamber connected with said incinerating chamber for supplying heated air into said incinerating chamber, and a burner for receiving feed from said means for supplying fuel and for discharging burning fuel into said air-heating chamber; means for by-passing, around said burner, fuel from said means for supplying fuel and supplying it directly into said air-heating chamber; valve means controlling flow of fuel through said means for by-passing said burner; and means for operating said valve means in accordance with the intensity of heat radiated by flames within said incinerating chamber as sensed by said radiation sensing means.

4. The improvement according to claim 3, wherein the radiation sensing means is a radiation pyrometer focused on a radiation-responsive target within the incinerating chamber.

* * * * *